US008919269B1

(12) United States Patent
Chen

(10) Patent No.: US 8,919,269 B1
(45) Date of Patent: Dec. 30, 2014

(54) SEWING MACHINE FEED MECHANISM

(71) Applicant: Chee Siang Industrial Co., Ltd., New Taipei (TW)

(72) Inventor: Man Chuing Chen, New Taipei (TW)

(73) Assignee: Chee Siang Industrial Co., Ltd., New Taipei (TW)

( * ) Notice: Subject to any disclaimer, the term of this patent is extended or adjusted under 35 U.S.C. 154(b) by 0 days.

(21) Appl. No.: 14/277,952

(22) Filed: May 15, 2014

(30) Foreign Application Priority Data

Aug. 23, 2013 (TW) ..... 102130162 A

(51) Int. Cl.
*D05B 27/14* (2006.01)

(52) U.S. Cl.
CPC ..... *D05B 27/14* (2013.01)
USPC ..... 112/304; 112/314; 112/320

(58) Field of Classification Search
CPC ..... D05B 27/00; D05B 27/14; D05B 27/04; D05B 27/10; D05B 27/12; D05B 27/16
USPC ..... 112/304, 314, 320, 303, 305, 322
See application file for complete search history.

(56) References Cited

U.S. PATENT DOCUMENTS 2,241,230 A * 5/1941 Wilmoth ..... 112/304
3,800,719 A * 4/1974 Rockerath ..... 112/304
4,432,295 A * 2/1984 Raisin et al. ..... 112/475.06
4,457,243 A * 7/1984 Bowditch ..... 112/470.12
4,462,530 A * 7/1984 Block et al. ..... 112/320
4,512,269 A * 4/1985 Bowditch ..... 112/470.06
4,632,046 A * 12/1986 Barrett et al. ..... 112/470.13
4,719,864 A * 1/1988 Barrett et al. ..... 112/470.06
4,922,842 A * 5/1990 Adamski et al. ..... 112/304
4,972,787 A * 11/1990 Adamski et al. ..... 112/308
5,018,416 A * 5/1991 Freermann ..... 112/304
5,129,171 A * 7/1992 Arbter et al. ..... 112/103
5,410,975 A * 5/1995 Dudek et al. ..... 112/113
5,461,999 A * 10/1995 Marcangelo ..... 112/306
5,505,406 A * 4/1996 Summey, III ..... 242/563.1
5,579,708 A * 12/1996 Kambara et al. ..... 112/155
6,095,070 A * 8/2000 Sahl ..... 112/220
6,123,039 A * 9/2000 Niino ..... 112/235

* cited by examiner

*Primary Examiner* — Danny Worrell
(74) *Attorney, Agent, or Firm* — Rabin & Berdo, P.C.

(57) ABSTRACT

A sewing machine feed mechanism is mounted on a work table of a sewing machine for transporting fabrics to be sewn, and includes a feed belt defining an encircled space; two belt wheels, on which two opposite ends of the feed belt are mounted; a driving source for driving the two belt wheels and the feed belt to rotate synchronously; a plurality of pressing elements located in the encircled space with respective bottom in contact with the feed belt; and an airbag located atop the pressing elements and connected to an external control device to have adjustable internal pressure. With these arrangements, the sewing machine feed mechanism has simplified structure to allow easy mounting/dismounting and reduced manufacturing cost thereof. Further, fabrics placed between the work table and the feed belt can be evenly pressed while being transported into a stitch forming area of the sewing machine for sewing.

6 Claims, 7 Drawing Sheets

SEWING MACHINE FEED MECHANISM

FIELD OF THE INVENTION

The present invention relates to a feed mechanism used to transport fabrics from a loading end to an unloading end of a sewing machine for sewing, and more particularly, to a sewing machine feed mechanism that internally includes a pressing mechanism configured as an airbag.

BACKGROUND OF THE INVENTION

A conventional sewing machine feed mechanism, as shown in FIG. 1, includes a feed belt 11 rotatably fitted on two spaced wheels 12*a*, 12*b*, a motor 13 connected to the feed belt 11 and driving the same to rotate, and a plurality of cylinders 14 connected to a pressure control system. When being driven by the motor 13 to rotate, the feed belt 11 brings fabrics placed between the feed belt 11 and a work table 10 to move horizontally into a stitch forming area of the sewing machine.

As can be more clearly seen in FIG. 2, the cylinders 14 respectively internally include a movable piston for actuating at least one pressing unit, and has a compressible fluid filled therein. The pressing unit includes rollers 15, pins 16, side brackets 17 and a pressing plate 18, and is in contact with an inner side of the feed belt 11. The pressure applied by the pressing unit against the transported fabrics can be adjusted via the compressible fluid in the cylinder 14 and the pressure control system.

The conventional sewing machine feed mechanism uses the cylinders 14 and the pressure control system connected thereto to adjust the pressure applied by the pressing units against the fabrics. Each of the cylinders 14 is communicably connected to an air-pressure tube and accordingly, involves relatively complicated mounting and dismounting procedures. Further, in the conventional sewing machine feed mechanism, every pressing unit requires one cylinder 14. Therefore, a large number of cylinders and air-pressure tubes are included in the feed mechanism to inevitably increase the manufacturing cost of the feed mechanism.

In view of the above disadvantages of the conventional sewing machine feed mechanism, it is desirable to develop an improved sewing machine feed mechanism that has simplified structure and reduced manufacturing cost, allows convenient mounting or dismounting thereof, and applies even pressure against the transported fabrics.

SUMMARY OF THE INVENTION

A primary object of the present invention is to provide a sewing machine feed mechanism that includes an airbag to apply even pressure against fabrics to be sewn. Further, with the airbag, the sewing machine feed mechanism can have simplified structure and can be easily and effortlessly mounted and dismounted to reduce the manufacturing cost thereof.

To achieve the above and other objects, the sewing machine feed mechanism according to the present invention is mounted on a work table of a sewing machine, and includes a feed belt defining an encircled space; two belt wheels on which two opposite ends of the feed belt are mounted; and a driving source for driving the two belt wheels and the feed belt to rotate synchronously, so as to feed fabrics placed between the work table and the feed belt into a stitch forming area of the sewing machine for sewing.

The sewing machine feed mechanism according to the present invention is characterized in further including a plurality of pressing elements located in the encircled space with respective bottom in contact with the feed belt, an airbag located atop the pressing elements and connected to an external control device capable of regulating an internal pressure of the airbag, and a hold-down plate located atop the airbag, such that the airbag in an inflated state can only generate a downward deforming force against the pressing elements. The pressing elements are respectively a pressure-bearing roller unit, which is automatically adjustable in its positional height in the encircled space. The pressure-bearing roller units respectively include at least one roller, which is mounted to between two side frames with two opposite ends of the roller connected to two locating brackets that are located outside the two side frames. And, a flexible supporting plate is further provided between the airbag and the pressure-bearing roller units.

The feed belt, the belt wheels, the pressing elements and the airbag are mounted to between the two side frames. The side frames are respectively provided with a plurality of mounting holes at positions corresponding to the rollers of the pressure-bearing roller units, and a plurality of locating holes located above and corresponding to the mounting holes. And, the locating brackets respectively include a connection section located outside the side frames and a plurality of spaced lug sections extended from the connection section for passing through the locating holes on the side frames.

The present invention is characterized in using an airbag to replace the cylinders in the conventional sewing machine feed mechanism, and providing a flexible supporting plate between the airbag and the pressing elements. With these arrangements, the sewing machine feed mechanism according to the present invention has effectively reduced manufacturing cost and can be conveniently mounted and dismounted to indirectly save a lot of labor cost, and can apply even pressure against the transported fabrics.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
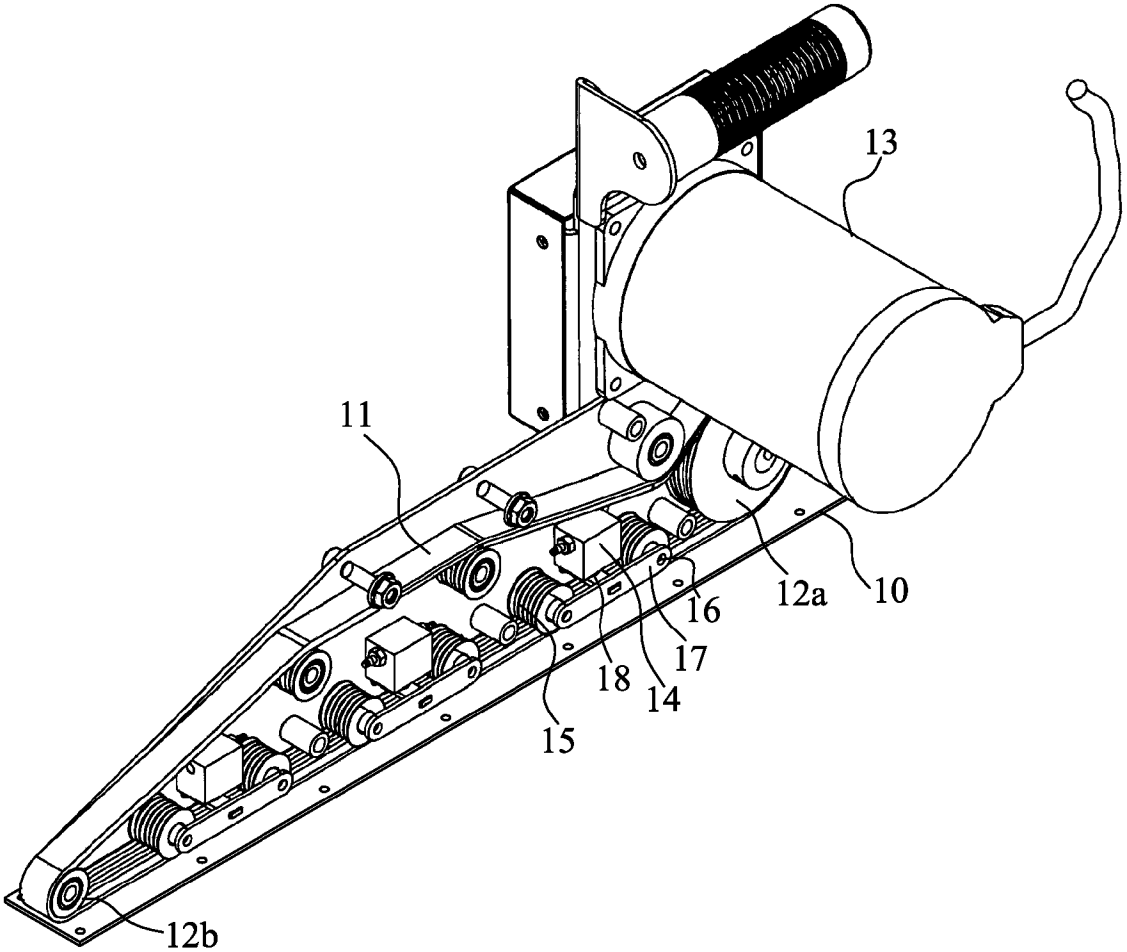
FIG. 1 (Prior Art)
FIG. 1 is a structural view of a conventional sewing machine feed mechanism.
Figure 2:
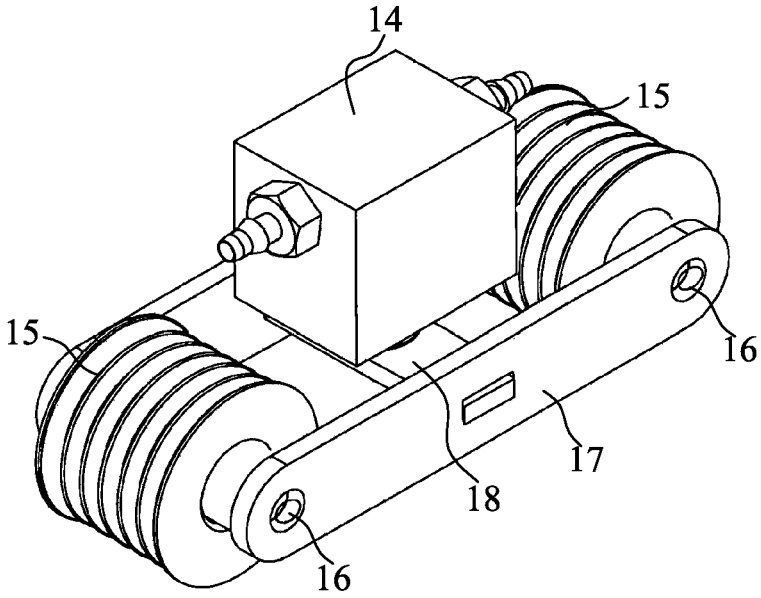
FIG. 2 (Prior Art)
FIG. 2 is an enlarged view of a pressing unit included in the conventional sewing machine feed mechanism shown in FIG. 1.

The present invention will now be described with a preferred embodiment thereof and with reference to the accompanying drawings. For the purpose of conciseness, the present invention is also briefly referred to as the feed mechanism and generally denoted by reference numeral 2 herein.

Figure 3:
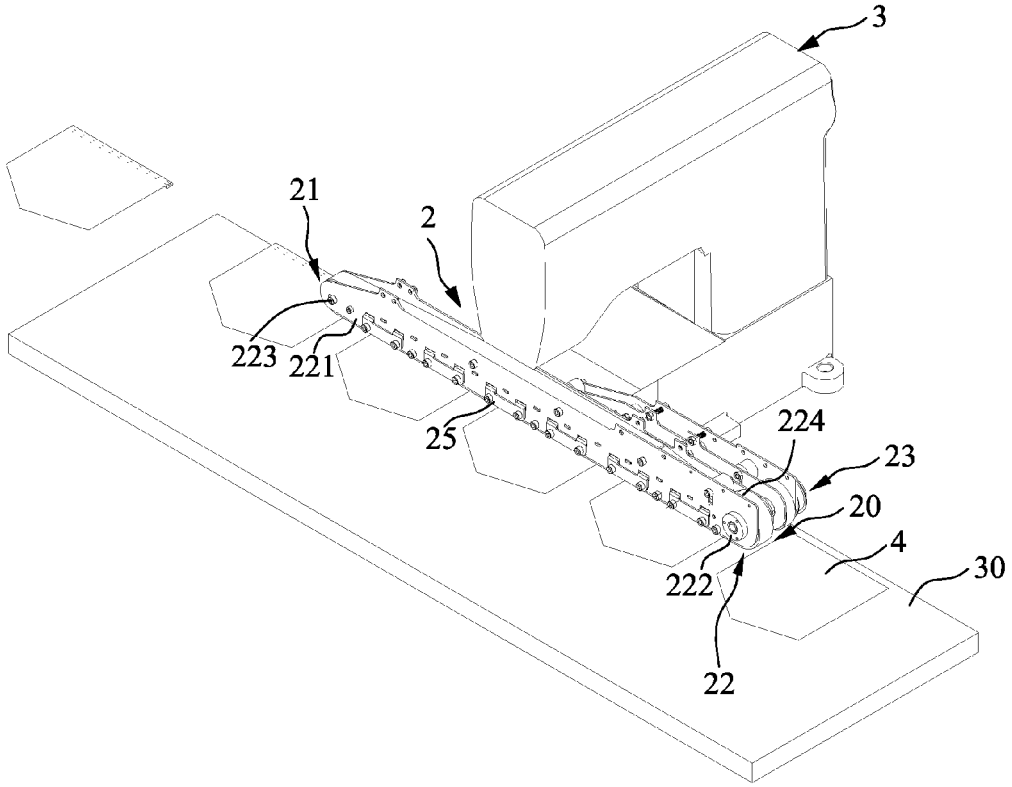
FIG. 3 is a structural view showing a sewing machine feed mechanism according to the present invention, which is mounted on a work table of a sewing machine.

Please refer to FIG. 3. A sewing machine feed mechanism 2 according to the present invention is used with a sewing machine 3 and mounted on a work table 30 of the sewing machine 3. On the work table 30, there are placed multiple pieces of fabrics 4 to be sewn. These fabrics 4 are sequentially moved into between the work table 30 and the feed mechanism 2 via a feed-in end 20 of the latter, and then horizontally transported to a stitch forming area of the sewing machine 3 for sewing. The sewn fabrics 4 form half-finished products, which are then output via a feed-out end 21 of the feed mechanism 2.

Figure 4:
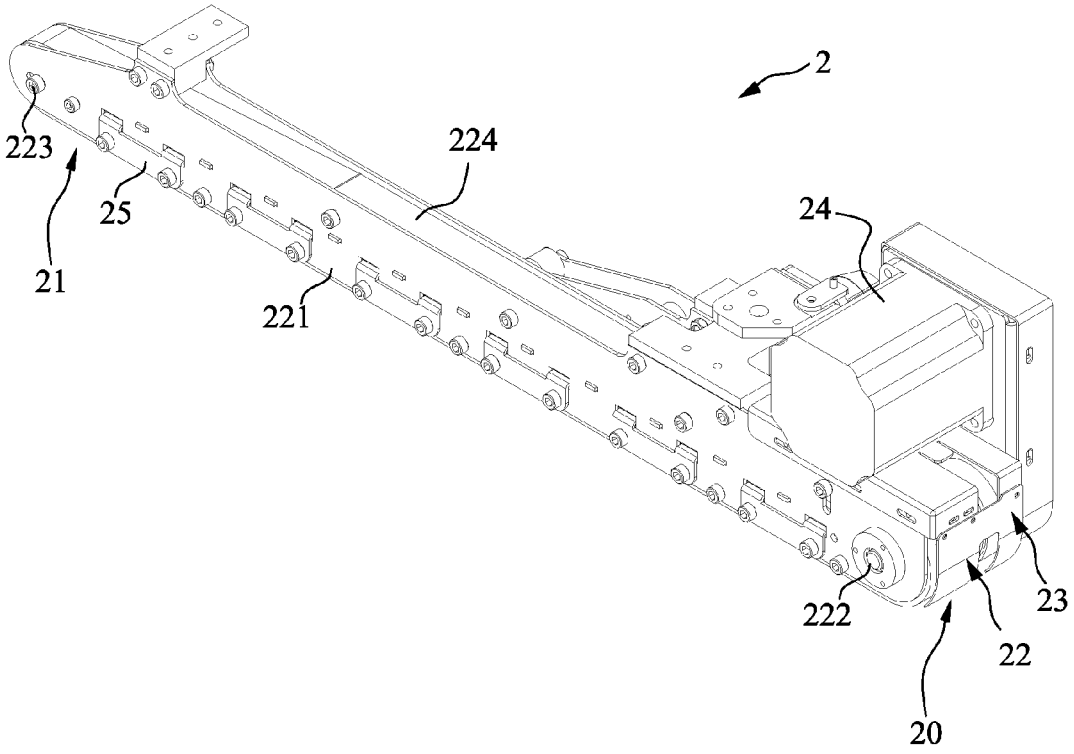
FIG. 4 is an assembled perspective view of the sewing machine feed mechanism of the present invention.

Please refer to FIG. 4. The feed mechanism 2 of the present invention includes a first feed assembly 22 and a second feed assembly 23, and a driving motor 24 serving as a common driving source shared by the first and second feed assemblies 22, 23.

Since the first feed assembly 22 and the second feed mechanism 23 have an identical internal structure and are different from each other only in their lengths, in this specification, only the first feed assembly 22 is described in detail. Description of the second feed assembly 23 is omitted herein.

Figure 5:
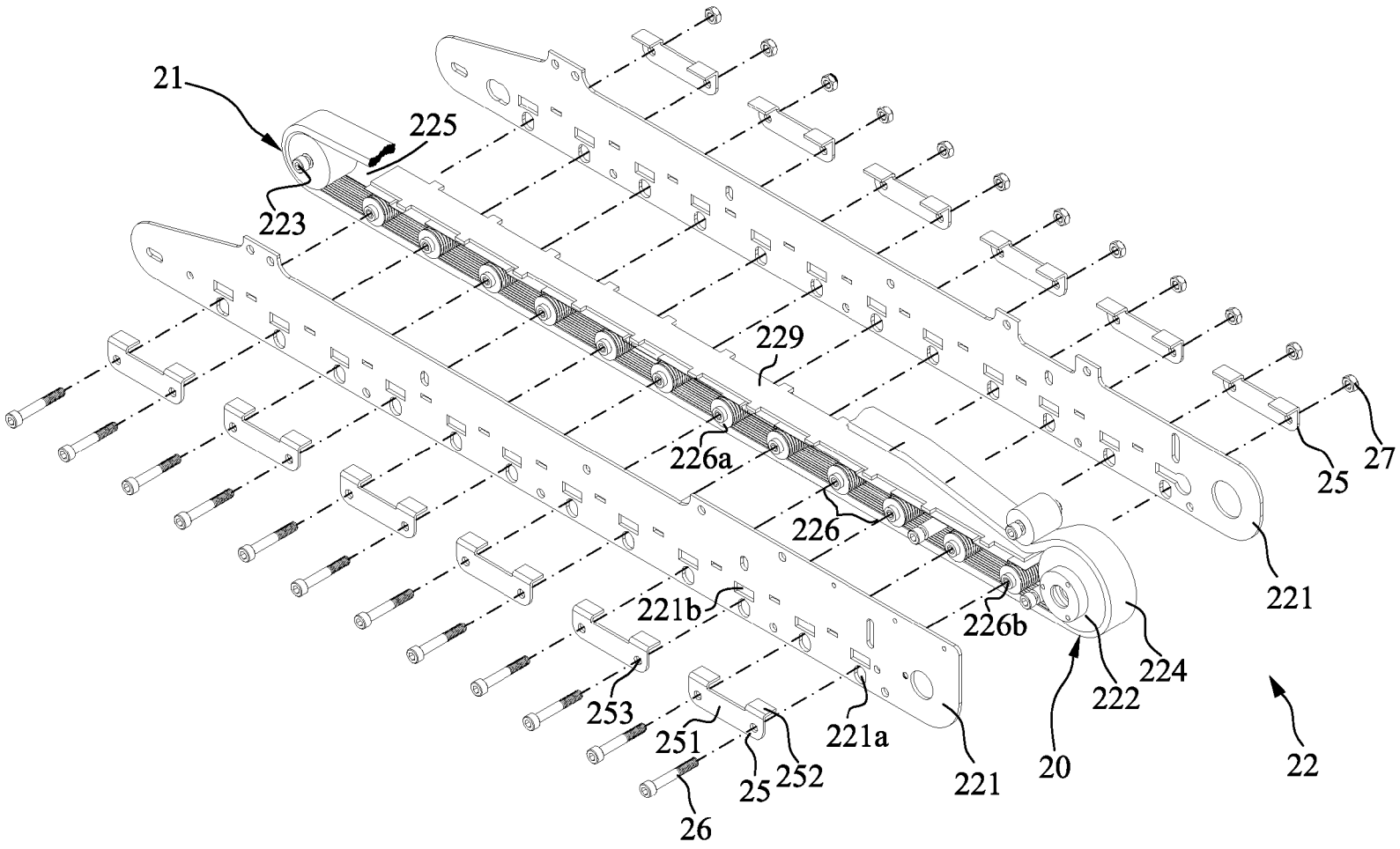
FIG. 5 is an exploded perspective view of a first feed assembly of the sewing machine feed mechanism shown in FIG. 4.

Please refer to FIG. 5. The first feed assembly 22 includes a pair of side frames 221; two belt wheels 222, 223 mounted to between a front and a rear end of the pair of side frames 221, respectively; and a feed belt 224 fitted on around the two belt wheels 222, 223 to define an encircled space 225 having a predetermined vertical height. The belt wheel 222 located between the front end of the pair of side frames 221 forms the feed-in end 20 of the feed mechanism 2, and the belt wheel 223 located between the rear end of the pair of side frames 221 forms the feed-out end 21 of the feed mechanism 2. The two belt wheels 222, 223 are driven by the driving motor 24 to rotate, and accordingly, bring the feed belt 224 to rotate synchronously with them. An outer surface of the feed belt 224 is in compressive contact with the fabrics 4 located between the work table 30 and the feed mechanism 2, such that the feed belt 224 in rotating can bring the fabrics 4 to move along with it.

Figure 6:
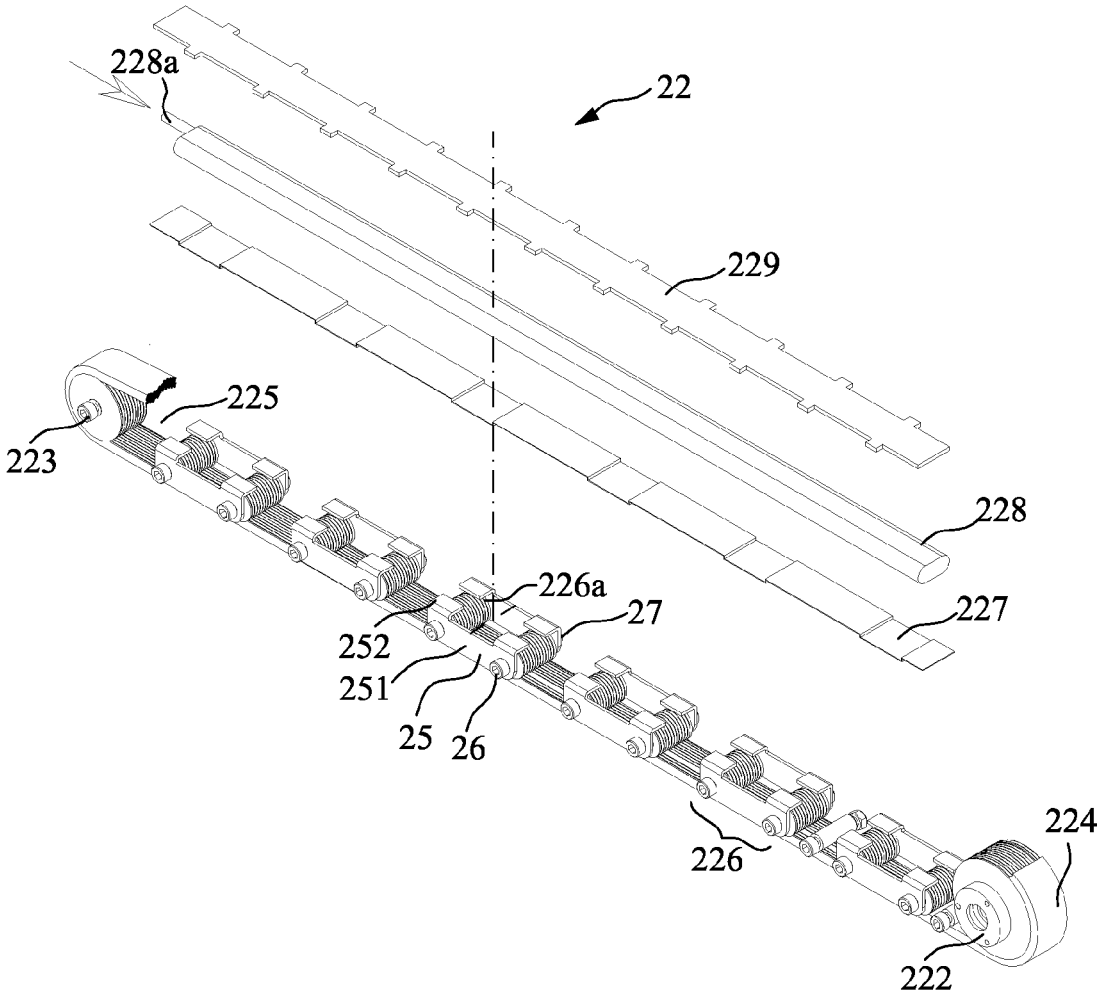
FIG. 6 is an exploded perspective view showing parts that are mounted in an encircled space in the first feed assembly of FIG. 5.
Figure 7:
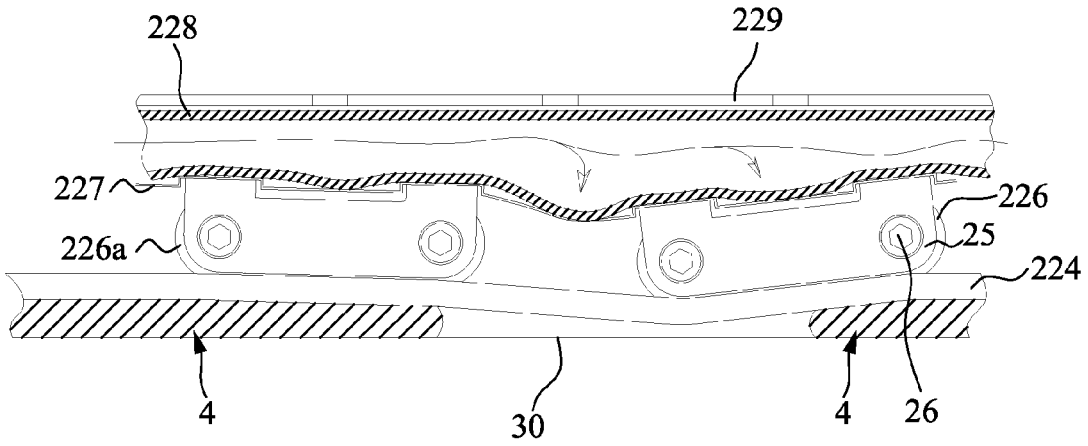
FIG. 7 is an enlarged, fragmentary sectional view showing the sewing machine feed mechanism of the present invention in a state of pressing against a fabric to be sewn.

Please refer to FIGS. 6 and 7. In the illustrated embodiment of the present invention, the first feed assembly 22 further includes a plurality of pressing elements 226, which are located in the encircled space 225 at a lower portion thereof and are spaced from one another; a flexible supporting plate 227 located atop the pressing elements 226; an elongate airbag 228 located atop the flexible supporting plate 227; and a hold-down plate 229 located atop the airbag 228.

The airbag 228 is provided with a valve 228*a*, which is in fluid communication with an air-pressure control device (not shown) located outside the feed mechanism 2. An internal pressure of the airbag 228 can be regulated via the air-pressure control device. The hold-down plate 229 is fixedly connected to the pair of side frames 221. When the airbag 228 is inflated and changes in volume, the hold-down plate 229 restricts the airbag 228 from expanding upward. That is, the airbag 228 can only expand downward and accordingly deforms the flexible supporting plate 227 located below the airbag 228. Meanwhile, the deformed supporting plate 227 generates a downward force against the pressing elements 226.

As can be seen from FIGS. 5 and 6, in the illustrated embodiment, the pressing elements 226 are respectively configured as a pressure-bearing roller unit. Every pressure-bearing roller unit 226 is located at a position that is height adjustable with changes of the internal pressure of the airbag 228. Further, a plurality of locating brackets 25 is mounted on the two side frames 221 at positions corresponding to the pressure-bearing roller units 226, so as to limit a range, within which the positional height of every pressure-bearing roller unit 226 is limited.

In the illustrated embodiment, the pressure-bearing roller unit includes two spaced rollers 226*a*, which respectively have an axially extended central through hole 226*b* and are in contact at a bottom with the feed belt 224. The side frames 221 are respectively provided at positions corresponding to the rollers 226*a* with a plurality of mounting holes 221*a*, and at positions immediately above the mounting holes 221*a* with a plurality of locating holes 221*b*. Further, the locating brackets 25 respectively include a connection section 251, which is located outside the side frames 221, and two laterally spaced lug sections 252 for correspondingly extending into two locating holes 221*b*. Further, every connection section 251 is provided near two opposite ends with two fastening holes 253, which are located corresponding to the central through holes 226*b* of the rollers 226*a*.

To assemble the feed mechanism 2 of the present invention, screws 26 are separately extended through the fastening holes 253 on the locating brackets 25 that are located outside one of the two side frames 221. Then, the screws 26 sequentially pass through the mounting holes 221*a* on the side frame 221, the central through holes 226*b* of the rollers 226*a*, and the mounting holes 221*a* on the other side frame 221 to respectively expose a partial threaded length from the fastening holes 253 on the locating brackets 25 that are located outside the other side frame 221. Finally, nuts 27 are separately tightened to the exposed threaded lengths of the screws 26, so that the locating brackets 25, the side frames 221 and the pressing elements 226 are coupled to one another. The locating holes 221*b* on the side frames 221 are rectangular openings that provide spaces for the lug sections 252 of the locating brackets 25 to be movably set therein, such that the lug sections 252 set in the locating holes 221*b* together form a support means in the encircled space 225 to support the flexible supporting plate 227 thereon.

Please refer to FIG. 7. While the fabrics 4 having been fed into between the feed mechanism 2 and the work table 30 for sewing are brought by the feed belt 224 to horizontally move in a predetermined direction, the internal pressure of the airbag 228 can be regulated for the feed mechanism 2 to distribute even pressure on the fabrics 4 in compliance with the specific thickness and the surface texture of the fabrics 4.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A sewing machine feed mechanism, being mounted on a work table of a sewing machine, comprising a feed belt defining an encircled space; two belt wheels, on which two opposite ends of the feed belt are mounted; and a driving source for driving the two belt wheels to rotate, such that the feed belt is brought to rotate synchronously with the two belt wheels and multiple pieces of fabrics placed between the feed belt and the work table for sewing are sequentially transported by the rotating feed belt into a stitch forming area of the sewing machine; the sewing machine feed mechanism being characterized in:

a plurality of pressing elements being located in the encircled space with respective bottom in contact with the feed belt; and an airbag being located atop the pressing elements and connected to an external control device capable of regulating an internal pressure of the airbag.

2. The sewing machine feed mechanism as claimed in claim 1, further comprising a hold-down plate located atop the airbag, such that the airbag in an inflated state can only generate a downward deforming force against the pressing elements.

3. The sewing machine feed mechanism as claimed in claim 1, further comprising a pair of side frames; and the feed belt, the belt wheels, the pressing elements and the airbag being mounted to between the two side frames.

4. The sewing machine feed mechanism as claimed in claim 3, further comprising a flexible supporting plate; the pressing elements respectively being a pressure-bearing roller unit mounted in between the two side frames at a position that is height adjustable; and the flexible supporting plate being located between the airbag and the pressure-bearing roller units.

5. The sewing machine feed mechanism as claimed in claim 4, wherein the pressure-bearing roller units respectively include at least one roller, the rollers being mounted to between the side frames with two opposite ends of the rollers connected to two locating brackets that are located outside the two side frames.

6. The sewing machine feed mechanism as claimed in claim 5, wherein the side frames are respectively provided with a plurality of mounting holes at positions corresponding to the rollers of the pressure-bearing roller units, and a plurality of locating holes located above and corresponding to the mounting holes; and the locating brackets respectively including a connection section located outside the side frames and a plurality of spaced lug sections extended from the connection section for passing through the locating holes on the side frames.

* * * * *